United States Patent [19]

Hale

[11] Patent Number: 4,700,651

[45] Date of Patent: Oct. 20, 1987

[54] FAIRING FOR TOW-CABLES

[75] Inventor: Neville E. Hale, Mississauga, Canada

[73] Assignee: Fathom Oceanology Limited, Mississauga, Canada

[21] Appl. No.: 684,840

[22] PCT Filed: Jan. 13, 1984

[86] PCT No.: PCT/US84/00037

§ 371 Date: Sep. 26, 1984

§ 102(e) Date: Sep. 26, 1984

[87] PCT Pub. No.: WO84/02890

PCT Pub. Date: Aug. 2, 1984

[30] Foreign Application Priority Data

Jan. 18, 1983 [CA] Canada ..... 419704

[51] Int. Cl.[4] ..... B63B 21/00

[52] U.S. Cl. ..... 114/243

[58] Field of Search ..... 114/243

[56] References Cited

U.S. PATENT DOCUMENTS

| | | | |
|---|---|---|---|
| 2,435,956 | 2/1948 | Craig | 114/243 |
| 2,859,836 | 11/1958 | Wiener | 114/243 |
| 2,949,090 | 8/1960 | Gerber | 114/243 |
| 3,092,067 | 6/1963 | Armstrong | 114/243 |
| 3,224,406 | 12/1965 | Clark | 114/243 |
| 3,343,516 | 9/1967 | Nichols | 114/243 |
| 3,407,777 | 10/1968 | Anastasio | 114/243 |
| 3,611,976 | 10/1971 | Hale | 114/243 |
| 4,075,967 | 2/1978 | Silvey | 114/243 |
| 4,567,841 | 2/1986 | Hale | 114/243 X |

FOREIGN PATENT DOCUMENTS

| | | | |
|---|---|---|---|
| 1559042 | 3/1969 | France | 114/243 |

*Primary Examiner*—Sherman D. Basinger

*Attorney, Agent, or Firm*—Donald E. Hewson

[57] ABSTRACT

The fairing disclosed has a streamlined, segmented, tail portion (63). The two-cable (40) passes through a hole (20) in the nose portion (18). The hole has a large clearance on the cable which allows frictionless rocking of the fairing side-to-side. This prevents any misalignment of the fairing from being locked in by friction. In addition, the segments (80, 90) are either provided with a physical mis-alignment control (84, 95), or the segments may be supported in tension, so that the individual segments do not rub against each other. Pliable links (101;112) are provided between segments that could otherwise rotate freely relatively, to give some torsional stiffness to control the fairing during winching.

7 Claims, 11 Drawing Figures

FAIRING FOR TOW-CABLES

There is described in U.S. Pat. No. 3,611,976, issued Oct. 12, 1971, to HALE et al., a fairing for tow cables that has, since its inception, become very successful. The fairing has a low drag co-efficient, is relatively inexpensive to make, can be developed with ease and without damage by the crew of the towing vessel even when the vessel is moving at speed, and has only a small tendency to indulge in "kiting".

"Kiting" is the term used to describe the following phenomenon. The fairing includes a tail portion whose function is to streamline the flow of water that has been parted by the cable back together without inducing turbulence. The tail portion has the characteristic airfoil profile needed to achieve this. The tail portion ideally should trail absolutely symmetrically to the direction of motion of the cable, and indeed the tail portion is urged to do so: if it starts to deviate from the symmetrical, a restoring force arises to urge it back. However, even though the restoring force does arise, nevertheless there has been a tendency for the tail portion to deviate slightly from the truly symmetrical position. If this happens, the fairing behaves like a rudder, and carries the cable off to one side. The condition, when it happens, is called "kiting". Sometimes the condition is not stable, the cable kiting first to one side then the other. It is an objective of the present invention to reduce kiting.

Kiting is caused by friction. The tail portion of the fairing has to be divided into segments, so that the fairing can easily flex as the cable flexes, in order that the fairing can follow the path of the cable when they are wound together onto a winch or pulley or sheave or drum, or when the cable adopts its normal catenary curve during use. Not only has the tail portion been segmented, but the nose portion, encircling the cable, has also been segmented. The segments are prevented from travelling along the cable by means of abutments placed at intervals along the cable. Each abutment holds a section of segments in position.

It has been the practice to stack a number of segments together to make up a section of fairing, one segment resting on top of the other, the bottom-most segment of that section resting on the abutment (which typically comprises a collar secured to the cable).

BRIEF DESCRIPTION OF THE INVENTION

One way, in the above described fairing, in which friction can cause kiting is that a segment is kept from perfect alignment by the friction between itself and adjacent segments. Another way in which a segment is prevented from aligning itself is by friction between the segment and the cable.

It is recognized in the invention that friction between the segment and the cable can be alleviated by a large clearance hole. The fairing can in this case easily swivel without any binding or interference due to tightness. The hole, and the cable, need not be made so accurately if the clearance is large. Apart from that, the large clearance has another benefit. In use, the cable tends to lie as far forward in the large hole as it can. The cable actually touches the fairing only at the very leading edge of the cable. The important aspect that follows from the large clearance is that the fairing can rock or roll about this point as a pivot to a certain extent. Thus, in order to swivel in response to movement through the water, the fairing may rotate by rocking or rolling (which is a substantially frictionless operation) instead of the fairing having to rotate about the cable axis, which would involve the fairing sliding around the cable surface. The permitted angle for which the rotation is frictionless is only a small one, but only a small angle is needed: if the fairing were very far out of alignment, the restoring force would be large enough anyway to overcome the friction. Thus, for small angular movements, the movement is frictionless: for large angular movements, normal rotational frictions start to arise. The greater moment, and the reduced friction, combine to maximise the freedom that the fairing has to make small angular movements, so as to align itself as accurately as possible to the flow of water.

Another benefit arises from the fact that the centre of rotation of the fairing is at the leading edge of the cable. The moment exerted by the natural restoring forces is the greater the further forward the centre of rotation.

However, a large clearance hole means that the segments can take up what is called a saw-tooth configuration, which will be described later. The effect of the saw-tooth configuration briefly is that the segment-to-segment friction and the segment-to-cable friction are both exacerbated by the presence of the other. Thus, it has not been possible hitherto to use large clearance holes, because large clearance holes permit the segments to take up the saw-tooth configuration, which makes the friction problem worse, not better.

It is recognized in the invention that, when the large clearance hole is to be provided, some means also has to be provided to prevent the segments from taking-up the saw-tooth configuration. This may be expressed alternatively by stating that, when the large clearance hole is to be provided, a means must also be provided to keep the segments from becoming locked, by friction, in misalignment with each other.

The means for preventing the frictionally-locked misalignment can be based, in the invention, on a manner of so located the segments mechanically one to another that they cannot physically become misaligned at all. Or, the means can be based on a manner of so arranging the segments that if misalignment should occur, the segments can become re-aligned without the need for any frictions to be overcome.

In this latter case, the segments can, for example, be suspended in tension from underneath an abutment on the cable, as contrasted with their being stacked one on top of another above the abutment.

Embodiments of the invention will be described, showing the large clearance hole, and having respectively either the physical constrained alignment or the alternative hanging suspension as their respective means for keeping the segments from becoming locked, by friction, in misalignment with each other.

PRIOR ART

Besides the HALE et al patent referred to, other U.S. patents have shown segmented-tail fairings, for example: WIENER, U.S. Pat. No. 2,859,836; GERBER, U.S. Pat. No. 2,949,090; NICHOLS, U.S. Pat. No. 3,343,516; and ANASTASIO, U.S. Pat. No. 3,407,777. None teach the use of a large clearance between the cable and the hole in the fairing.

Of patents that show a continuous-tail (i.e., non-segmented) fairing, ARMSTRONG, U.S. Pat. No. 3,092,067; and CLARK, U.S. Pat. No. 3,224,406, both show a clearance. The clearance is not, however, great enough to permit the fairing to rock frictionlessly about the cable, at least for small angular movements, as is called for in the invention. The invention lies in the combination of a large clearance hole with a means for keeping the segments from being held in misalignment by friction. Nothing in the prior art teaches such a combination.

The invention will now be further described by way of example, with reference to the accompanying drawings, in which.

DETAILED DESCRIPTION OF PREFERRED EMBODIMENT

Figure 1:
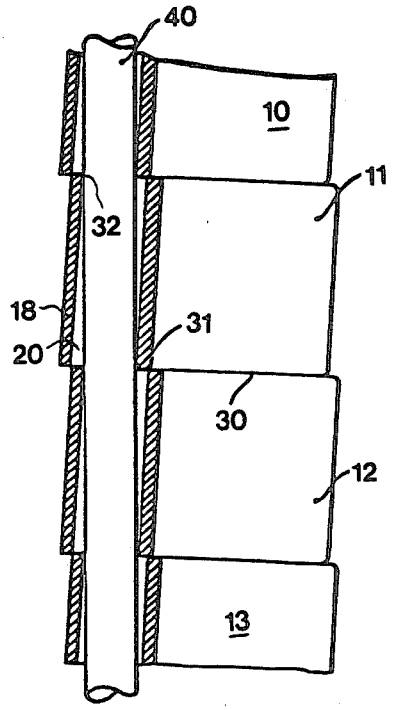
FIG. 1 is a longitudinal cross-section of fairing segments on a tow-cable.

In FIG. 1, segments 10–13 of fairing are stacked one on top of another. Each segment has a respective nose portion 18 and tail portion 19. The nose portion has a hole 20 in it, the hole 20 having a large clearance over a tow-cable 40, as may be seen from FIG. 1.

Friction arises at the interface 30 between segments. Friction also arises at the contact points 31, 32 between a segment 11 and cable 40. These frictions oppose relative lateral movement of the segments with respect to the cable.

Once the tail portions 19 of the segments are almost symmetrical to the flow of water, the force tending to align the tail portions 19 evewn more symmetrically drops off to a very small value. The friction is too much for the—now tiny—restoring forces, with the result that the segments cannot quite move to the absolutely symmetrical condition. They are locked, by the friction, in slight misalignment. The arrangement shown in FIG. 1 is an example of such misalignment, and is known as the saw-tooth configuration. It is a particularly bad case of friction-locked misalignment because the friction between the segments tends to keep the segments held at an angle relative to the cable, which in turn causes further contact, and hence friction, between the segments and the cable itself. It is an aim of the invention to prevent the saw-tooth configuration from occurring.

Figure 2:
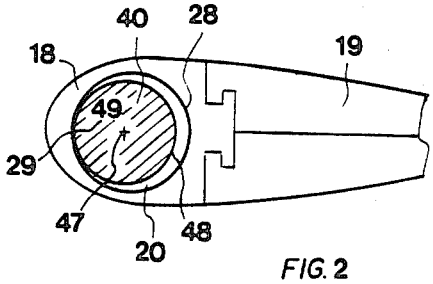
FIG. 2 is a lateral cross-section of a fairing on a tow-cable.

FIG. 2 shows a tow cable 40 in a large-clearance hole 20 in the nose portion 18 of a fairing. Normally, rotation of the fairing about the cable 40 takes place such that the centre 47 of the cable 40 is the centre of the rotation, and the inside surface 28 of the hole 20 slips or rubs, with attendant friction, over the outside surface 48 of the cable.

When the fairing is in operational use, the leading edge 49 of the cable 40 is as far forward in the hole 20 as it can be, so that in fact the leading edge 49 touches the hole 20 at the point 29. (Point 29 is, of course, only one point on a line of contact extending down the cable.) Because the clearance is large, some small angular movement of the fairing can take place in which the fairing rocks about the point 29 as a pivot, or the fairing may be regarded as rolling around the leading edge 49 of the cable 40. In any event, the small angular movement can take place without the friction that is normally associated with large rotational movements of the fairing around the cable. The permitted extent of this frictionless movement is quite small, but this is acceptable because if the fairing were to be grossly out of alignment, the restoring forces would then be large enough to overcome the friction. It is only over the last two degrees or so from absolute alignment that the frictionless motion is needed.

Figure 3:
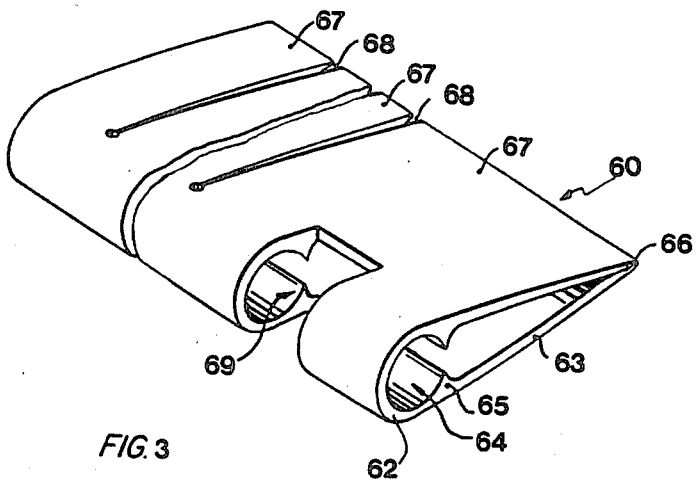
FIG. 3 illustrates a section of fairing.

Turning now to the manner of constructing the fairing, a first exemplary construction is that shown in FIG. 3. Here, a section 60 of fairing is formed as a single unitary whole, from a plastic extrusion. The extruded profile includes a nose portion 62 and a tail portion 63. The nose portion 62 includes a circular hole 64, wings 65 being included in the profile to further define the hole 64. The hole is of such a diameter that it is a large clearance fit over the tow-cable 40. A slit 66 is provided in the tail portion 63 so that the fairing may be assembled radially to the tow cable 40. The slit 66 may be cemented or welded together after assembly.

The tail portion 63 of the section 60 of fairing is divided into segments by the provision of lateral slits 68. The slits 68 go right through the tail portion 63, and through half the nose portion 62 too; the segments 67 created by the slits 68 are short enough that the whole length of the section 60 of fairing can easily flex as the fairing is winched, with the cable, onto a drum. The slits 68 also introduce some torsional compliance into the section 60 which is sometimes needed, not particularly for operational efficiency under water, but to allow the fairing to twist as it passes around whatever arrangement of pulleys and so on that may be provided on a particular vessel.

Towards what will be the upper end of the section 60, the nose portion 62 is provided with a gap 69. When the section 60 is assembled to the cable 40, an abutment ring attached to the cable 40 occupies the gap 69. The section 60 hangs from that ring, there being no other abutments provided to support that section.

There is a further benefit that has not yet been mentioned, arising from supporting the section by hanging it in tension from an upper abutment, as contrasted to stacking it upon a lower abutment. When the cable and fairing are being winched, inevitably the section of fairing shuffles along the cable to some extent. Since the lower end of the section is free, this causes no real problem. But if the lower end were not free, heavy stresses would accumulate at the abutment point, leading easily to breakage of either the fairing or the abutment ring.

In the embodiment of FIG. 3, misalignment between the segments 67 cannot occur due to the fact that the segments are all in the same piece of material. Therefore the hole 64 may have a large clearance on the tow cable 40 without any of the problems of the saw-tooth configuration.

Figure 4:
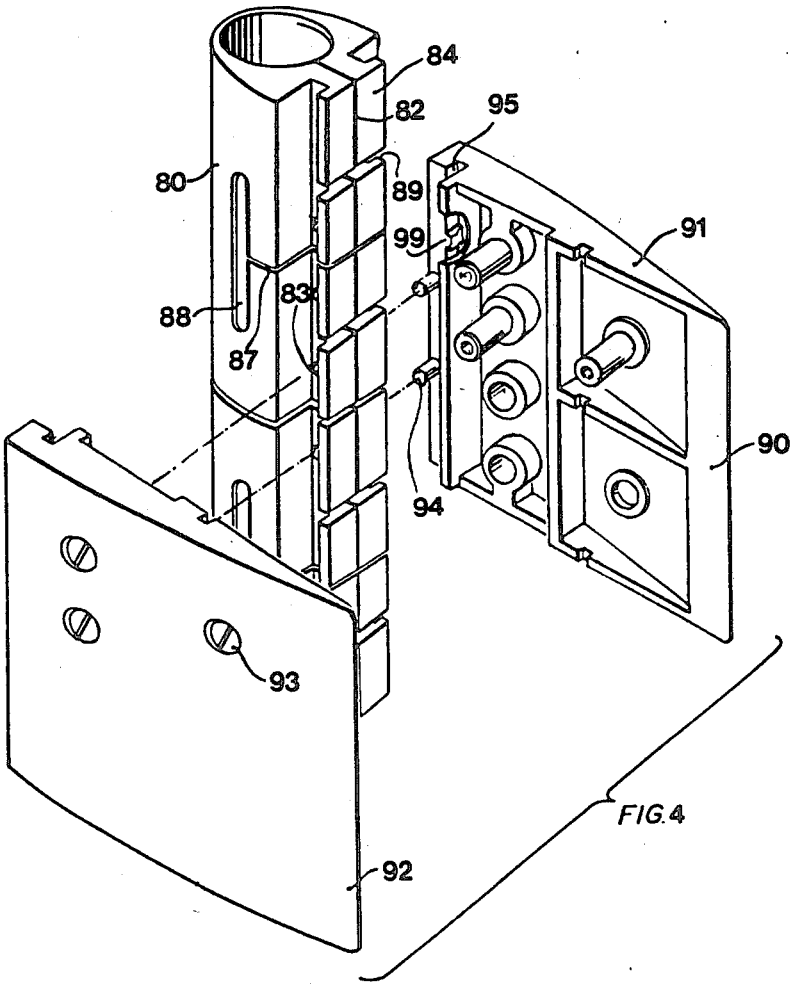
FIG. 4 illustrates part of an alternative section of fairing, shown exploded.

Another embodiment is shown in FIG. 4. The segments 90 of the tail portion now are formed in two halves 91,92 which are identical plastic mouldings. The nose portion is also in segments 80, and it is arranged in this illustration that the nose segments 80 are equal in length to the tail segments 90. The nose segments each have a slit 82, which can be prised open to allow the nose segment 80 to be assembled onto the tow-cable 40. The two halves 91,92 of the tail segment 90 are then brought together, as will be appreciated from FIG. 4: when held together the halves 91,92 lock the nose segment 80 onto the cable 40. When assembly of the segments to the cable takes place in the factory, the halves 91,92 are secured by welding or cementing. If repairs have to be done to the cable while at sea, new segments can be secured just by means of screws 93.

The tail segments 90 are located on the nose segments 80 by means of pins 94 which fit in complementary sockets 83 in the nose segment 80, to locate the segments against relative axial movement; and by the grooves 95 and flanges 84 as illustrated, which ensures that there can be no other movements between the nose and tail segments. The segments fit smoothly together, to avoid creating turbulence.

Figure 5:
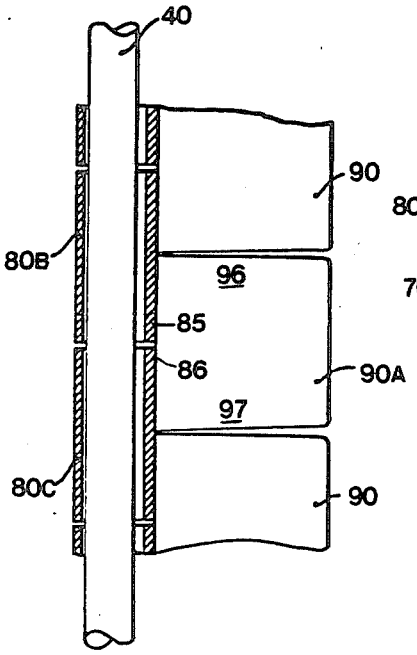
FIG. 5 is a longitudinal cross-section of the fairing of FIG. 4.

As best shown in FIG. 5, the fail segments 90 are staggered with respect to the nose segments 80; that is, the upper part 96 of the tail segment 90A is fixed to the nose segment 80B and the lower part 97 of the tail segment 90A is fixed to the nose segment 80C. This ensures that the lower part 85 of nose segment 80B cannot move laterally (i.e., at right angles to the axis of the tow-cable) with respect to the upper part 86 of nose segment 80C, and hence the nose segments 80B, 80C cannot adopt a saw-tooth configuration. FIG. 5 should be compared with FIG. 1.

Figure 6:
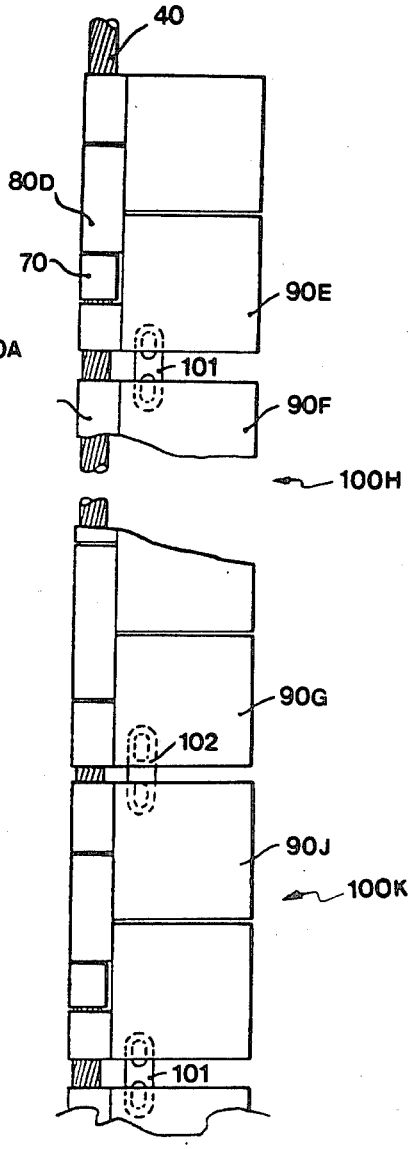
FIG. 6 shows the section of fairing of FIG. 4 assembled to a tow-cable.

FIG. 6 shows a section 100H of fairing suspended from a respective abutment ring 70. The weight of a section 100H rests against the ring 70, and hence there inevitably must be some friction between the ring 70 and that segment 80D which actually touches it. So that this friction shall not interfere with the rest of the segments 80,90 in the section 100H, a pliable link 101 is interposed between the segments. It would not do for the segments to be allowed to swing freely, because that would interfere with the efficient winching of the cable and fairing: each segment should be able to transmit at least some degree of torsional stiffness to adjacent segments. This transmission of torsional stiffness is required also between the bottom tail segment 90G in the section 100H and the top tail segment 90J of the next section 100K below, and a further link 102 is provided for that purpose. The link 101 carries the weight of the section 100H; it permits a large degree of torsional compliance to avoid transmitting friction, yet it provides some torsional restraint to control the fairing during winching. The link 102 carries no weight, and is just there to provide torsional restraint for the winching control purposes.

The function of the link 102 may also be regarded in the following manner.

It will be noted from FIG. 6 that there is a gap between the bottom segment 90G of the section 100H and the top segment 90J of the section 100K. This gap can vary due to the manufacturing variations, expansions of the fairing or the cable, and varying drag forces on the fairing. Also, the gap will vary if and when the fairing shuffles along the cable during winching. It is important that the link 102, which bridges the gap just referred to, is held in place in such a way that the link transmits no tension between the segments 90G and 90J. The link 102 prevents the sections from rotating independently of each other: but each section hangs from its own respective abutment ring 70 and none of the suspension weight is taken by the link.

(In fact, the term "weight" is not quite accurate. The plastic from which the segments are made has little weight in sea water. The downward force arises because the cable does not hang vertically but trails out behind the towing vessel. Hence the fairing tends to be swept downwards along the cable by the drag forces on the fairing, and this tendency reinforces the actual weight of the segments.)

The nose segment 80D is the one that actually rests against the ring 70. It is arranged that this nose segment holds the two tail segments in alignment, as shown in FIG. 6. Shortened nose segments make up the difference in length. The segment 80D might have been prone to taking the saw-tooth configuration, but this is avoided by the effectively extra long length of the location of the segment 80D on the cable. As will be appreciated from FIG. 1, the longer the segments, the less the saw-tooth effect.

Figure 7:
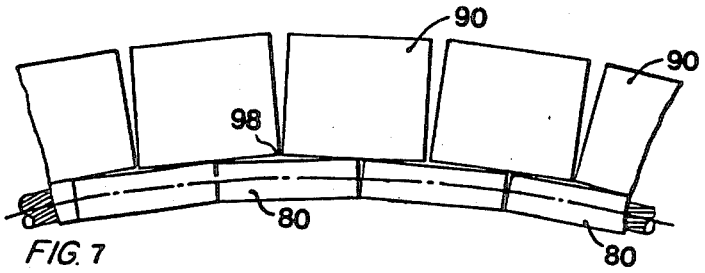
FIG. 7 and FIG. 8 show sections of fairings being winched.
Figure 8:
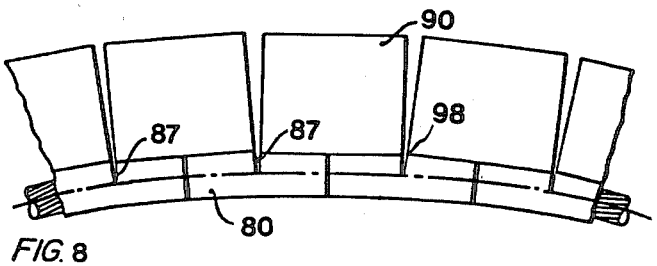
Figure 10:
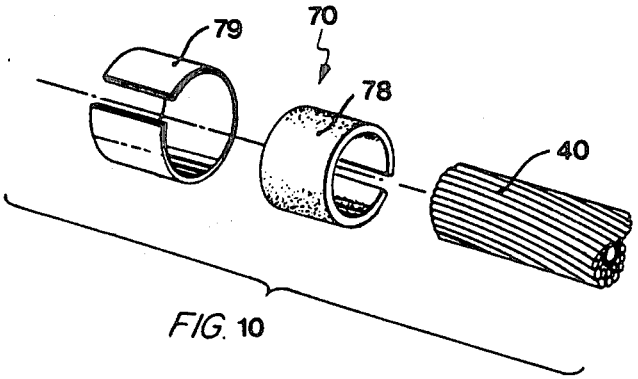
FIG. 10 shows an abutment ring for a tow-cable.

FIG. 7 shows the positions the segments would take up when being wound onto a winch, if the nose segments 80 were solid. The nose segments 80 are however, provided with lateral slits 87, as shown in FIG. 10, and FIG. 4. These slits 87 allow the tail segments 90 to separate even at their innermost ends 98. This should be contrasted with the FIG. 7 situation where the ends 98 are forced to be substantially in contact. The effect in the FIG. 7 situation is that the nose segments 80 become crushed axially, while the tail segments 90 are stretched. Since these distortions are never equal, the fairing tends to shuffle along the cable 40. In FIG. 8, the nose segments 80 can cater on their own for virtually all the distortion because of the lateral slits 87, so that shuffling along the cable no longer causes a problem. The effect of the slits 87, as shown in FIG. 8, is therefore advantageous over the FIG. 7 effect.

Some of the nose segments 80 in a section 100 may have their lateral slits 87 extended longitudinally, as at 88 (FIG. 4). This gives the fairing the freedom to undergo gross torsional distortions, which can be required on some vessels if the cable has to follow a tortuous path when it is being winched. All the nose segments 80 in a section 100 might have the longitudinal slits, or just one, or none, depending on the vessel. (The same applies to the one-piece section shown in FIG. 3.)

Even with these precautions to relieve stresses between the segments 80,90 during winching, it can happen that forces do arise which can break off the pins 94. A shear block 99 is incorporated (when moulding the halves 91,92 of the tail segment 90) in the groove 95, and so placed and dimensioned as to fit one of the slots 89 in the flange 84. The shear blocks 99 therefore can save the pins from damage from abusive stresses such as might occur when the segments tend to shuffle along the cable during winching.

Figure 9:
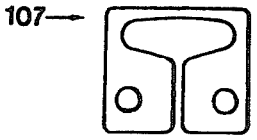
FIG. 9 shows a link used in fairings.

During winching, the links 101,102 (FIG. 6) can be subjected to distortions that can damage them. The more resilient design of link 107 that is shown in FIG. 9 can be used to alleviate such a problem, if needed.

It will be noted that links 101,102 disposed as in FIG. 6 will be required with the one-piece-section 60 of fairing shown in FIG. 3, to control the sections 60 during winching. It will be noted also that the slits 68 in that embodiment extend far enough into the nose portion 62 to allow the fairing to flex in the manner of FIG. 8 rather than that of FIG. 7.

The abutment rings 70 referred to are constructed in the manner shown in FIG. 10. First a split ring of synthetic rubber 78 is slipped over the cable 40. Then a band of a hard brass 79 is fitted over the rubber ring 78. The band 79 has enough circumferential length that its ends overlap, and the ends are soldered together. The rubber is coated with adhesive to stick the rubber both to the cable and to the band. The adhesive is cured by heat from the soldering operation. The rubber 78 is provided so that the ring 70 has the resilience it needs to prevent it from breaking when the cable 40 flexes during winching, and to cushion the cable to prevent the ring from acting as a stress concentrator.

Figure 11:
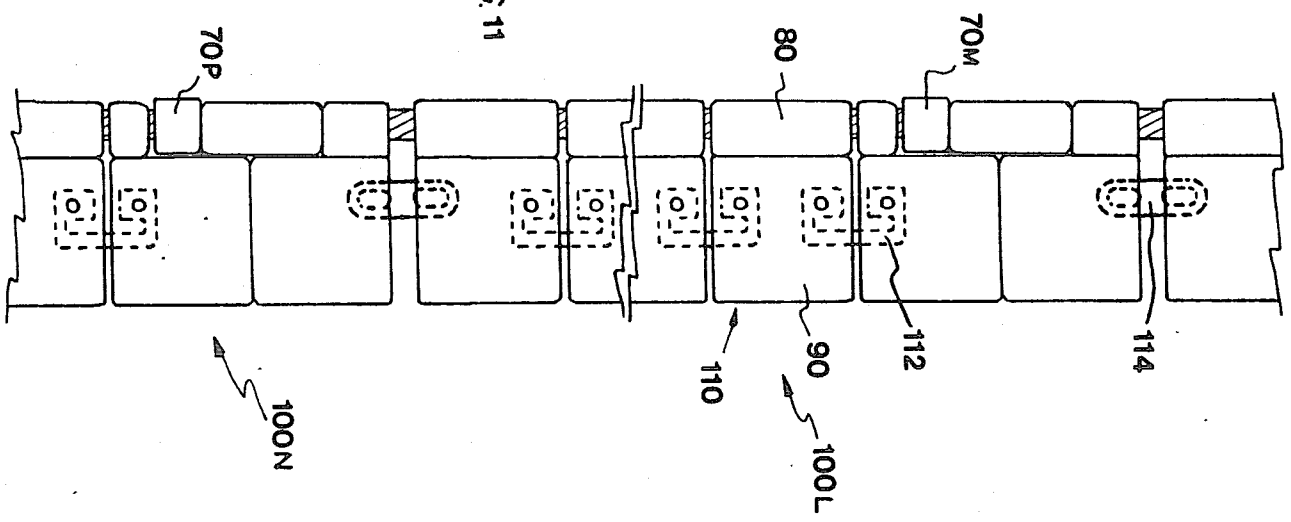
FIG. 11 is an elevation of alternative fairing.

In FIG. 11, the tail segments 90 and the nose segments 80 are not staggered: otherwise they are as illustrated in FIG. 4. A section 100L of segments hangs from an abutment ring 70M. A section 100N hangs from another ring 70P.

Each segment assembly 110 (comprising a nose segment 80 and a respective tail segment (90)) hangs from the adjacent segment assembly above, suspended on a link 112. Thus, each segment assembly is free to take up its own position of symmetry on the cable. There is no friction between the segments, which might cause relative misalignment of the segments to be locked in.

The links 112 are of such a length as to hold the segments slightly apart, as shown, so that there can be no friction-producing contact. As before, the sections must not however be allowed to swing freely with respect to the other sections. Torsion links 114 are therefore added; it will be observed from FIG. 11 that the links 114 carry none of the weight of the sections, just as the links 102 in FIG. 6 carried no weight.

The links 112 are compliant in the axial direction. When the faired cable is being winched, the nose segments 80 tend to be forced together, the tail segments 90 being forced apart, as described earlier. The links tend to be forced together, the tail segments 90 being forced apart, as described earlier. The links 112 are constructed so that they stretch during winching. The links 114 are slotted to accommodate any shuffling movement of the segments along the cable.

I claim:

1. Fairing for a tow-cable, the fairing having a tail portion which is constructed and arranged to adopt a trailing orientation with respect to the cable;

wherein the tail portion is divided into segments which are short enough, measured axially along the length of the cable, to permit the fairing to distort sufficiently that the cable and the fairing can be wound together on a winch;

wherein the fairing includes a nose portion which encircles the cable, to the extent of constraining the fairing from becoming detached from the cable;

the fairing being characterised by the following combination of features:

said nose portion has a large clearance on the cable, such that when the fairing is in the trailing orientation, and the leading edge of the cable is as far forward with respect to the encircling portion as it can be, the fairing can, in that condition, rock or roll frictionlessly from side to side with respect to the cable at least through an angle of two degrees, without sliding or rubbing against the cable;

said nose portion is slit so that it may be prised open to allow it to be assembled radially onto the cable;

the nose and tail portions are separate pieces adapted to be assembled together after the nose piece is on the cable;

the nose and tail portions are both divided into respective segments, such that adjacent segments of the nose portion are separate pieces, and adjacent segments of the tail portion are separate pieces;

segments of the tail portion are staggered with respect to segments of the nose portion, in that a segment of the tail portion is connected to more than one segment of the nose portion, and in that a segment of the nose portion is connected to more than one segment of the tail portion; and means is provided which keeps the segments of the tail portion from becoming locked, by friction, in misalignment with each other; which means comprises:

a means for locating the tail segments each to adjacent tail segments such that substantially no relative movement between the tail segments can occur in a direction at right angles to the cable axis; and a means for suspending segments in sections, each section being suspended in tension underneath a respective abutment on the cable, such that there are substantially no contact forces between adjacent tail segments, nor between the tail segments and other parts of the fairing or cable.

2. Fairing of claim 1, wherein the connection between the nose segments and the tail segments is such that at the point of connection the segments are as one, in that no relative movement in any sense or direction can take place between the two connected segments; and wherein the separate segments of the tail portion are not connected together other than through their connections with the segments of the nose portion.

3. Fairing of claim 2, in which at least one of the segments of the nose portion in a section is made especially pliant in a torsional sense, by the provision of slits extending laterally across the nose segment, and axially along the nose segment.

4. Fairing of claim 2, in which the nose segments and the tail segments are provided with complementary flanges and grooves, to locate the tail segments to the nose segments against movement in all directions and senses except movement relative to each other in the direction of the cable axis;

wherein pins in one of the segments engage complementary sockets in the other of the segments to locate the sockets against the said relative movement; and wherein shear blocks are provided in one of the segments to engage complementary slots in the other of the segments to provide an additional location against the said relative movement.

5. Fairing of claim 1, wherein the section is suspended from the abutment by means of a pliable link, which is flexible enough to transmit substantially no frictional resistance from the abutment to the section, yet is stiff enough to provide the section with sufficient torsional resistance to permit winching the cable and fairing.

6. Fairing of claim 1, where segments in a section are each suspended from the segment immediately above by means of a pliable link, the link being so constructed and arranged as to permit slight relative rotation between the segments to take place without friction, the link having sufficient torsional stiffness to prevent gross relative rotation between the segments during winching.

7. Fairing of claim 6, wherein the link is so dimensioned and arranged that the link locates adjacent segments almost but not quite touching each other during towing, but the links are resilient enough in the axial direction to permit the tail segments to spread apart when the cable is winched onto a drum.

* * * * *